US008608218B1

(12) United States Patent
Marthens

(10) Patent No.: US 8,608,218 B1
(45) Date of Patent: Dec. 17, 2013

(54) APPARATUS AND METHOD FOR HANDLING PRODUCTS ON SHELVES

(76) Inventor: Bradley F. Marthens, Ada, MI (US)

( * ) Notice: Subject to any disclaimer, the term of this patent is extended or adjusted under 35 U.S.C. 154(b) by 90 days.

(21) Appl. No.: 13/419,774

(22) Filed: Mar. 14, 2012

(51) Int. Cl.
*A47G 23/06* (2006.01)

(52) U.S. Cl.
USPC ..... 294/172; 294/173; 211/59.3

(58) Field of Classification Search
USPC ..... 294/7, 26, 26.5, 27.1, 172–173, 219; 15/257.1–275.3; 211/59.1–59.3; 312/244; 53/247, 475; D32/74; D7/691
See application file for complete search history.

(56) References Cited

U.S. PATENT DOCUMENTS 6,155,438 A * 12/2000 Close ..... 211/59.3
6,502,875 B1 * 1/2003 Berry ..... 294/27.1
7,703,614 B2 * 4/2010 Schneider et al. ..... 211/59.3
7,743,458 B1 * 6/2010 Moore et al. ..... 15/257.2
2009/0261607 A1 * 10/2009 Braver ..... 294/26

* cited by examiner

*Primary Examiner* — Stephen Vu
(74) *Attorney, Agent, or Firm* — Gardner, Linn, Burkhart & Flory, LLP

(57) ABSTRACT

A method of handling products on shelves comprises providing a pan member including a base portion connected to a back portion with the back portion including a handle member and being angularly oriented relative to the base portion, with the base portion including a front edge and the back portion being connected to the base portion opposite the front edge. The method includes placing the front edge of the pan member adjacent a plurality of products stored on a shelf, sliding the pan member and at least a portion of the products relative to each other such that at least a portion of the products are contained in the pan member. The front edge may be positioned perpendicularly relative to the elongate length of the shelf and a biasing force may be provided to the products, such as by way of a retention arm member.

9 Claims, 8 Drawing Sheets

APPARATUS AND METHOD FOR HANDLING PRODUCTS ON SHELVES

BACKGROUND OF THE INVENTION

The present invention is directed to an apparatus and method for removing products from shelves and, more particularly, for removing retail products from store shelving.

Retail store facilities frequently display large quantities of products together on shelving units for purchase by consumers, with such products being arranged in orderly rows and in an upright manner. Occasionally such products must be removed from the shelving units, such as to relocate the products to a different shelf within the facility and/or to rearrange the shelving units themselves. Upon being moved, the products must be restocked on the shelving units, presenting a time consuming and labor intensive operation.

SUMMARY OF THE INVENTION

The present invention provides a method and apparatus for handling products stored on shelves.

According to an aspect of the present invention, a method of handling products on shelves comprises providing a pan member including a base portion connected to a back portion with the back portion including a handle member and being angularly oriented relative to the base portion, with the base portion including a front edge with the back portion being connected to the base portion opposite the front edge. The method further includes placing the front edge of the pan member adjacent a plurality of products stored on a shelf, sliding the pan member and at least a portion of the products relative to each other such that at least a portion of the products are contained in the pan member whereby the contained products may be moved from the shelf.

In particular aspects the method may further include placing the front edge of the pan member adjacent a plurality of products in a perpendicular orientation relative to the elongate length of the shelf and sliding the pan member and at least a portion of the products relative to each other in a direction parallel to the elongate length of the shelf. Still further, a biasing force may be provided to the products opposite the pan member such that the products are positioned between the biasing force and the pan member. A retention arm member may be provided for use in providing the biasing force, which may include a handle member at one end of an elongate shaft, with the shaft being held generally parallel relative to the front edge of the pan member The retention arm member may also include a hook member that is angled relative to the shaft and is distally located from the handle member.

The pan member has first and second distal ends and may include an end portion connected to the base portion and the back portion at the first end and an open end at the second end, that is the open end may not include a separate member connected to the base and back portions. Still further, the length of the base portion of the pan member may be sized to be approximately equal to the width of the shelf upon which the products are stored.

The method may further comprise positioning the pan member adjacent a shelf when the pan member contains a plurality of products for storage on the shelf with the front edge of the pan member in contact with the shelf and sliding the products out of the pan member such that the products are positioned on the shelf.

According to another aspect of the present invention, a method of handling products on shelves comprises providing a pan member, placing a plurality of products in an upright orientation into the pan member, positioning the pan member adjacent a shelf with the front edge of the pan member in contact with the shelf, and sliding the products contained in the pan member out such that the products are positioned on the shelf in an upright orientation.

The pan member, which may be as described above, may be positioned adjacent a shelf with its front edge in contact with the shelf in a perpendicular orientation relative to the elongate length of the shelf, wherein the products contained in the pan member are slid out in a direction parallel to the elongate length of the shelf. A biasing force may be applied to the products while they are slid out of the pan member such as by, for example, a users hand and/or arm or by a retention arm member.

After sliding the products contained in the pan member out of the pan member, the method may further comprise placing the front edge of the pan member adjacent a plurality of the products stored on the shelf and sliding the pan member and at least a portion of the products relative to each other such that products are contained in the pan member whereby the contained products may be moved from the shelf.

The disclosed apparatus and method for removing and restocking shelves enables various items, such as retail goods or other such products, to be quickly and efficiently moved, including moving multiple of such items simultaneously while maintaining their orientation and arrangement. Significant time and cost savings are therefore provided with respect to conventional practices such as individually moving products by hand.

These and other objects, advantages, purposes and features of this invention will become apparent upon review of the following specification in conjunction with the drawings.

DESCRIPTION OF THE PREFERRED EMBODIMENTS

Figure 1:
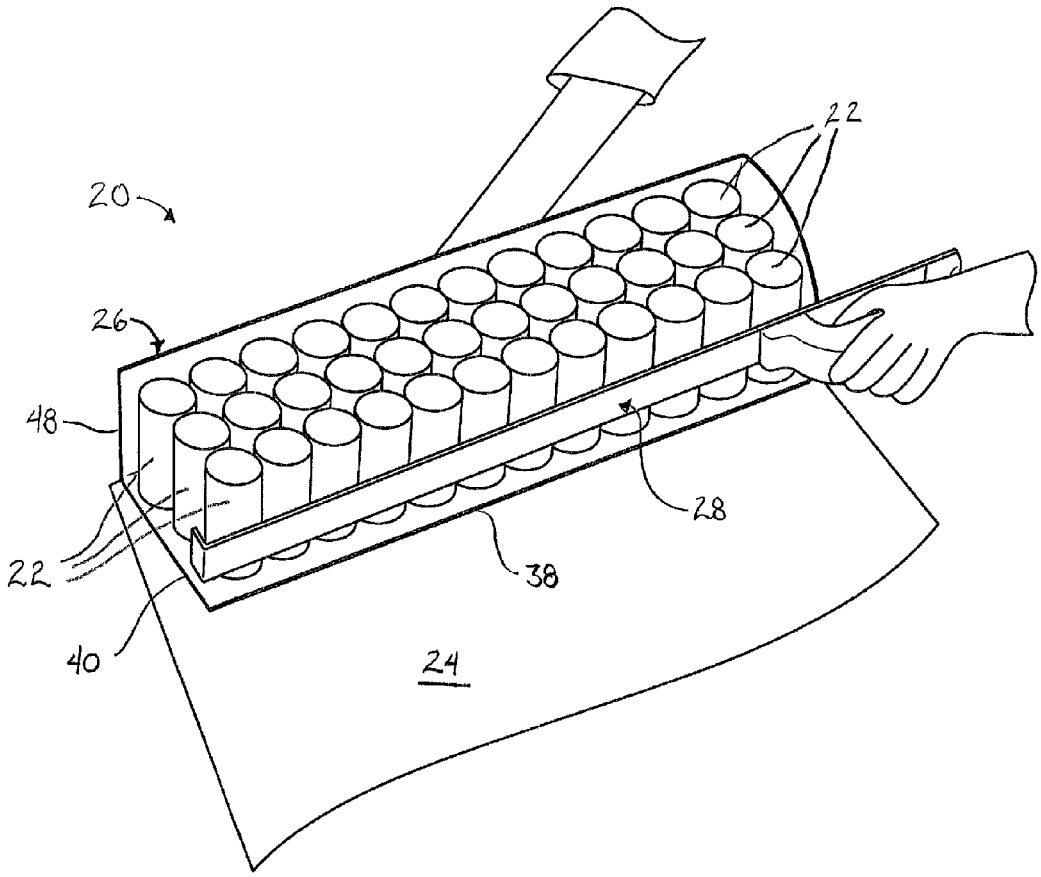
FIG. 1 is a perspective view of the apparatus of the present invention being utilized to remove or restock product on a shelf by a user.
Figure 2:
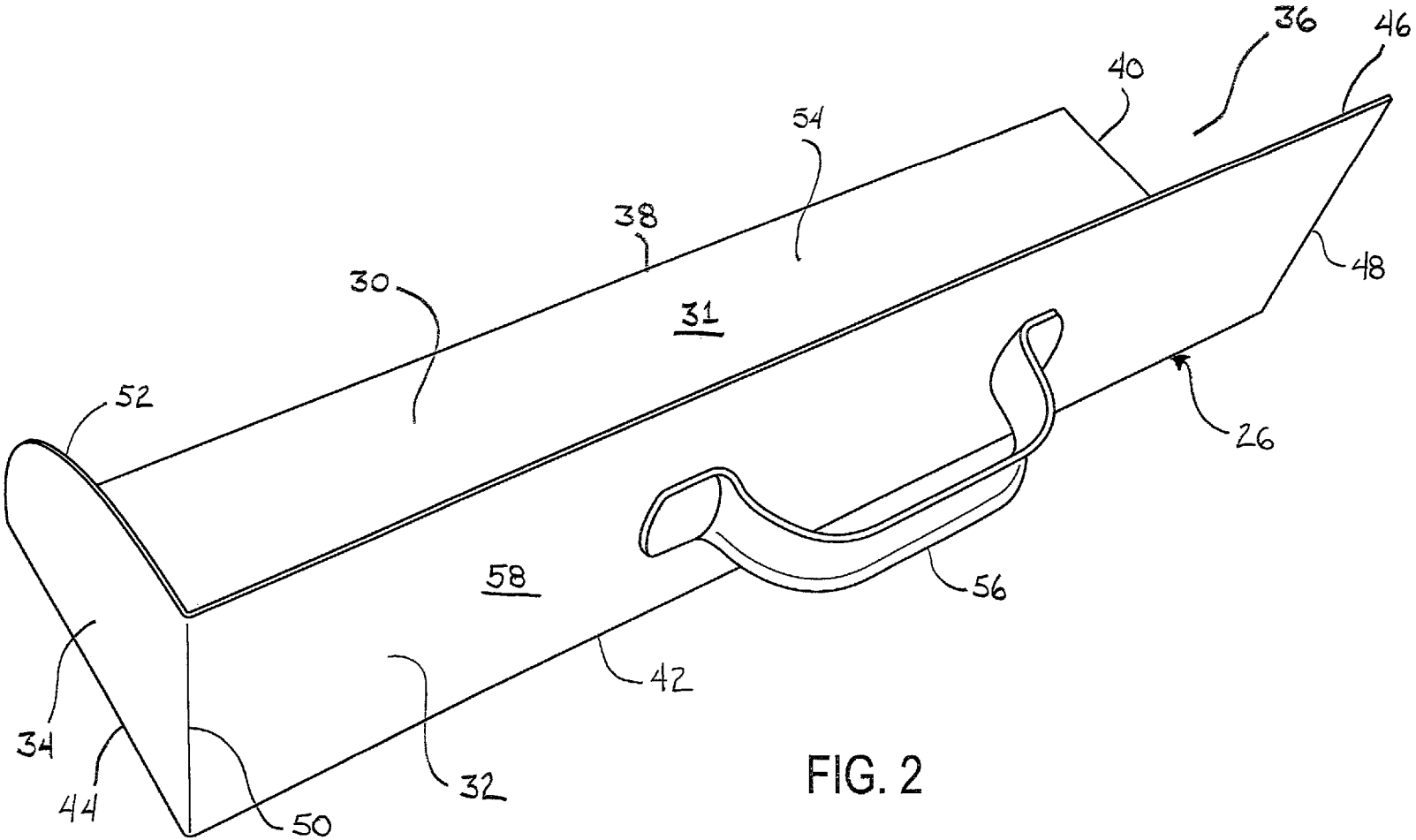
FIG. 2 is a rear perspective view of the apparatus of FIG. 1 shown apart from a shelf and user and without the product.
Figure 3:
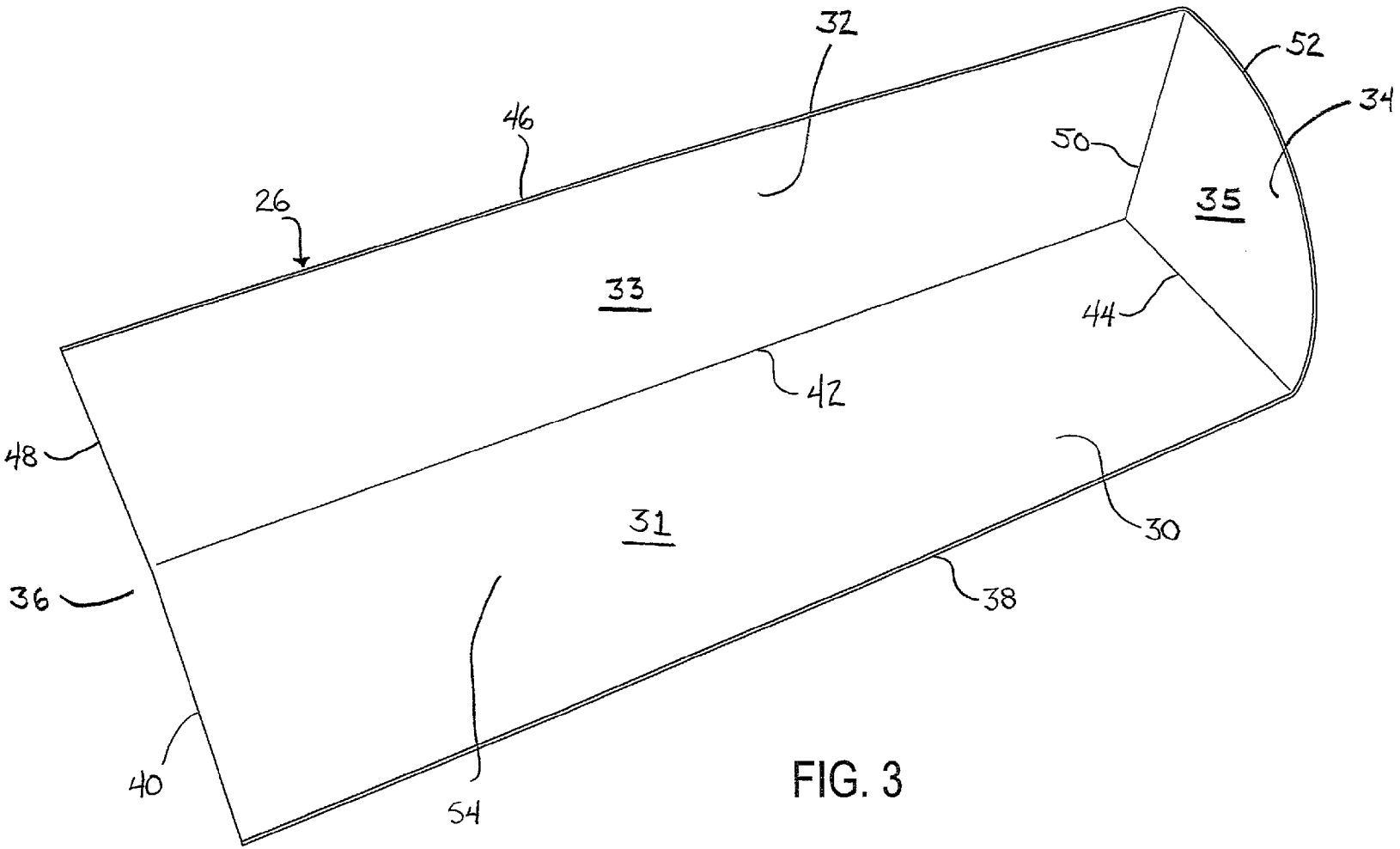
FIG. 3 is a front perspective view of the apparatus of FIG. 2.
Figure 4:
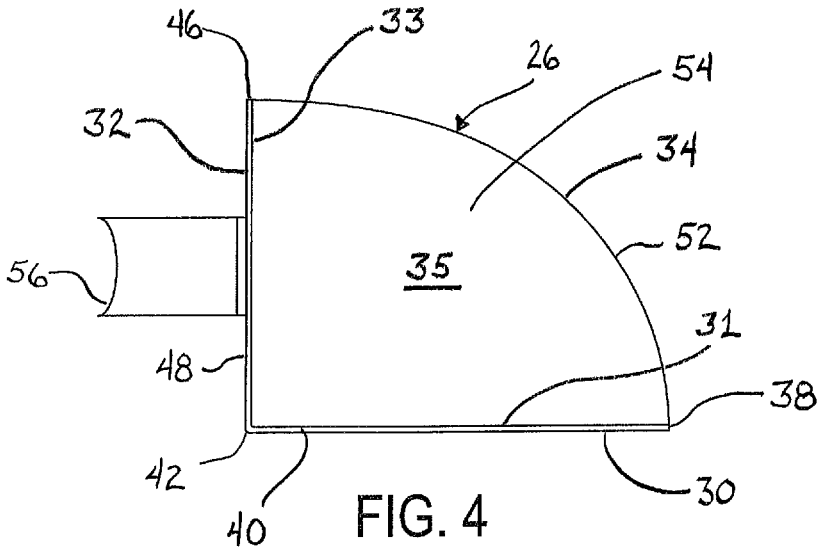
FIG. 4 is an elevation view of the open end of the apparatus of FIG. 2.
Figure 5:
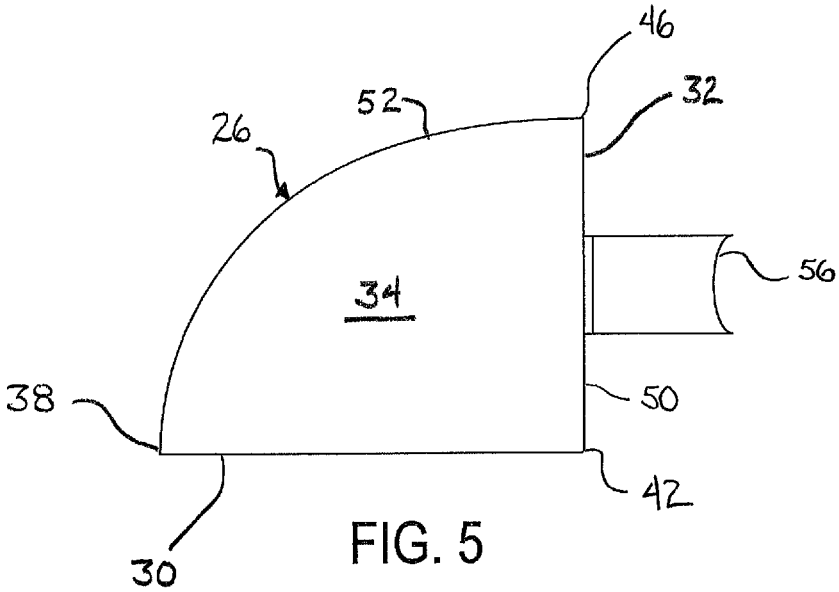
FIG. 5 is an elevation view of the opposite end relative to FIG. 4.
Figure 6:
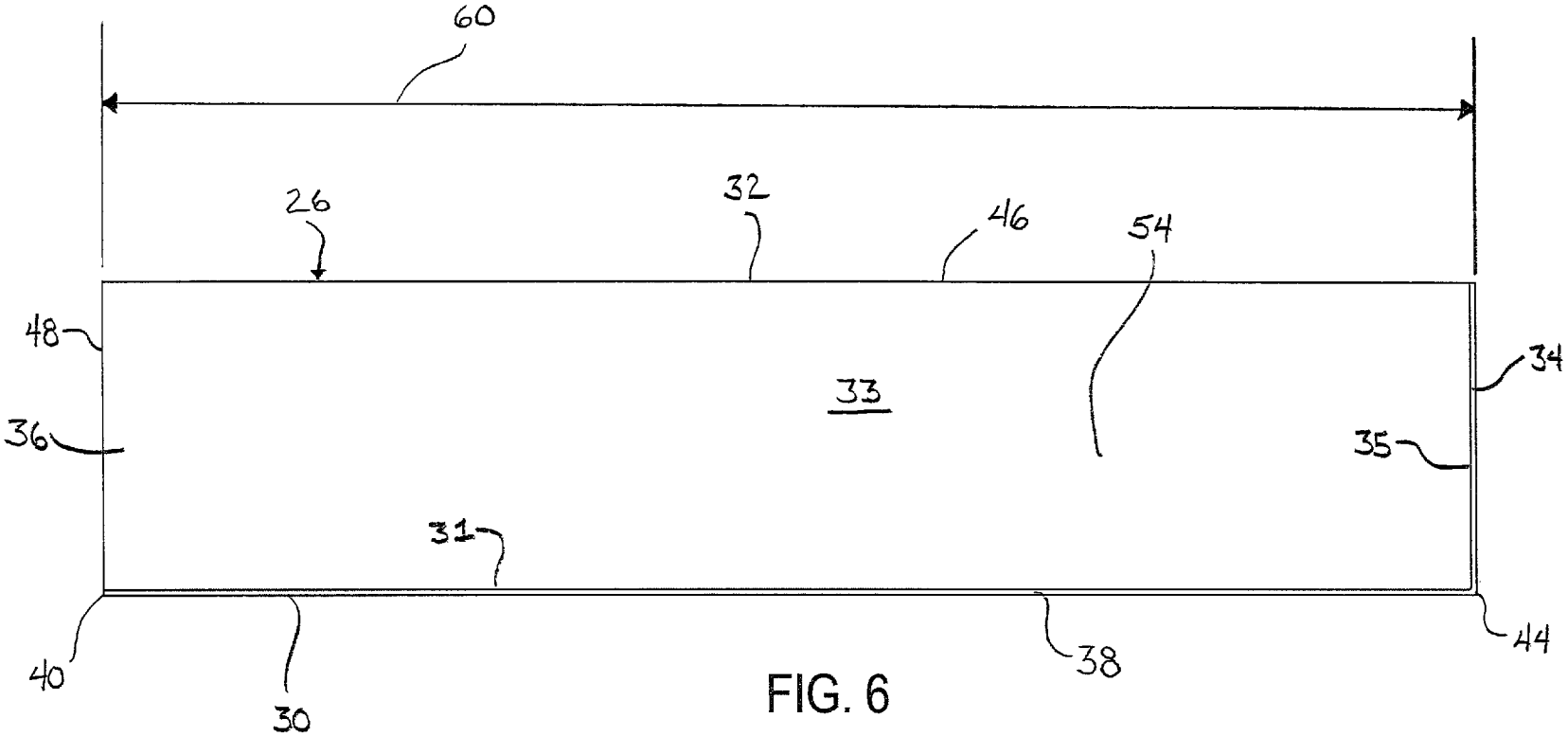
FIG. 6 is a front side elevation view of the apparatus of FIG. 2.
Figure 7:
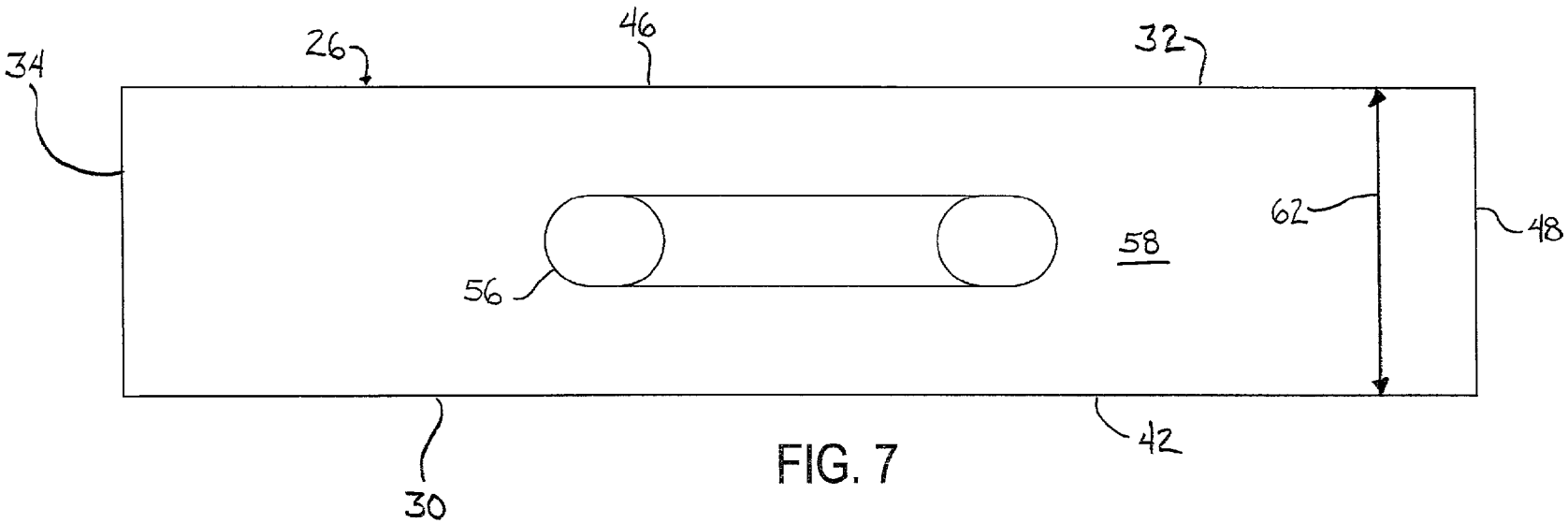
FIG. 7 is a rear side elevation view of the apparatus of FIG. 2.
Figure 8:
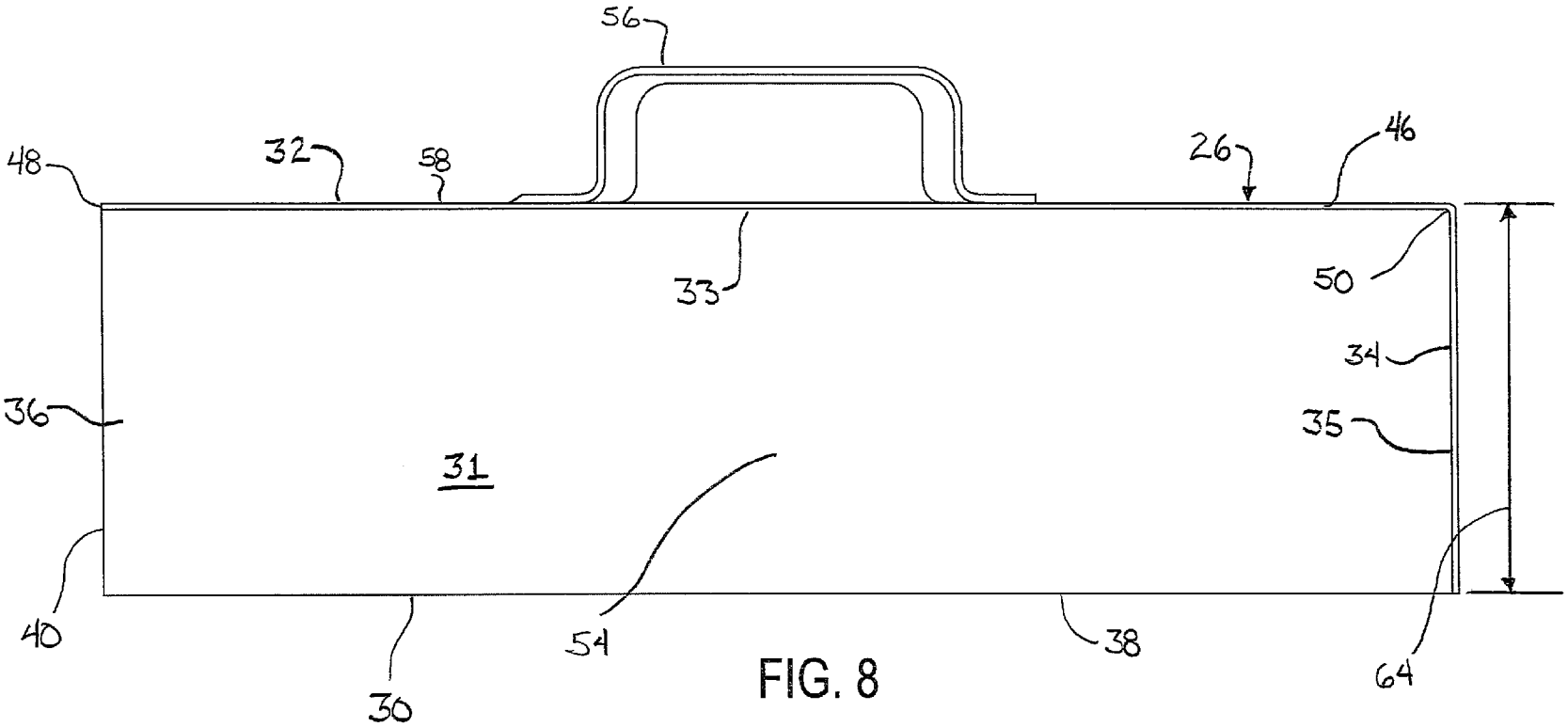
FIG. 8 is a top elevation view of the apparatus of FIG. 2.

The present invention will now be described with reference to the accompanying figures, wherein the numbered elements in the following written description correspond to like-numbered elements in the figures. Referring to FIG. 1, the numeral 20 illustrates an apparatus in accordance with the present invention for simultaneously removing and/or restocking a plurality of products 22 from or onto a shelf 24 comprising a pan or scoop member 26 and a retention arm member 28.

Products 22 of FIG. 1 represent general retail merchandise, and may be any of numerous types of goods such as food, personal care, household items or the like. As is known, like goods are displayed together on retail shelving, such as shelf 24, with the goods being arranged in rows in an upright manner for display to retail consumers.

In use, a user is able to hold pan member 26 with one hand and retention arm member 28 with the opposite hand. Multiple products 22 located together on shelf 24 may be simultaneously picked up by scooping pan member 26 under products 22 on shelf 24. Retention arm member 28 may optionally be utilized when removing products 22 from shelf 24 by being positioned as shown in FIG. 1 to provide a biasing force against products 22 to prevent products 22 from being displaced or slid along shelf 24. Conversely, products 22 may be deposited on shelf 24 by positioning pan member 26 into a desired location and tipping pan member 26 to dispense products 22 onto shelf 24. Retention arm member 28 may optionally be utilized when depositing products 22 onto shelf 24 by being positioned as shown in FIG. 1 to control the rate at which products 22 are tipped out of pan member 28.

Referring now to FIGS. 2-8, pan member 26 includes an elongate, generally rectangular base or bottom portion 30, a correspondingly elongate, generally rectangular back or side portion 32, an end or rear portion 34, and an open end 36 opposite end portion 34. As best understood from FIG. 3, base portion 30 includes an inner surface 31, back portion includes an inner surface 33, and end portion 34 includes an inner surface 35. Base portion 30 includes a front edge 38 and an end edge 40, with base portion 30 being connected to back portion 32 at a shared edge or joint 42 opposite front edge 38 and base portion 30 being connected to end portion 34 at shared edge or joint 44 opposite end edge 40. Back portion 32 also includes an upper edge 46 and an upright end edge 48, with back portion being connected to end portion 34 at a shared edge or joint 50. End portion 34 includes a curved edge 52 extending from upper edge 46 to front edge 38.

In the embodiment shown, base portion 30 is connected with back portion 32 to form a substantially right angle, with end portion 34 similarly forming substantially right angles relative to base portion 30 and back portion 32. Accordingly, base portion 30, back portion 32 and end portion 34 define a product receiving area 54. A handle member 56 is disposed on a rear surface 58 of back portion 32.

Pan member 26 has a length 60 (FIG. 6), which in the embodiment shown may be between approximately 10 and 28 inches. It should be appreciated, however that alternative lengths may be employed such as, for example, to accommodate alternative widths of shelves upon which products 22 may be stored. Correspondingly pan member 26 has a height 62 (FIG. 7) of approximately 5 inches, and a width 64 (FIG. 8) of approximately 5 inches.

Figure 9:
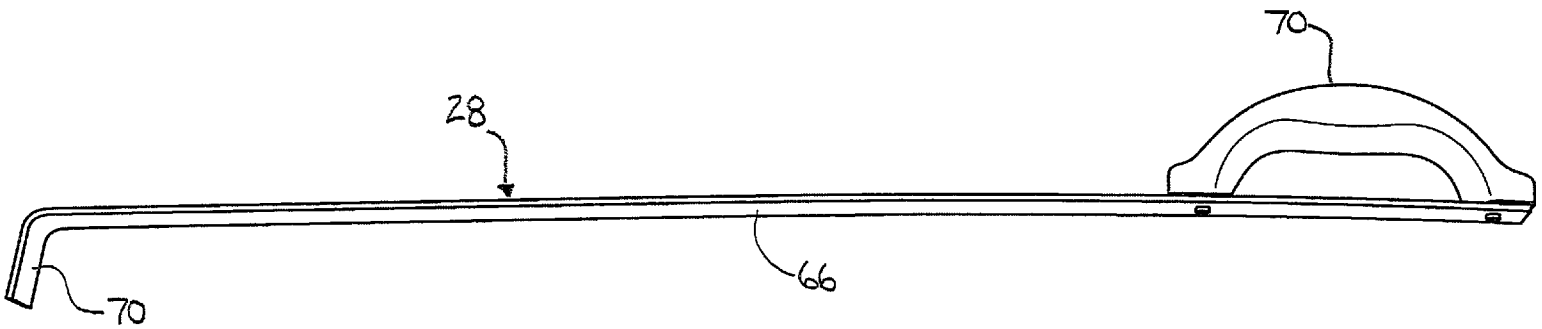
FIG. 9 is a perspective view of the retention arm member of FIG. 1.

Referring now to FIG. 9, the illustrated retention arm member 28 includes an elongate, substantially straight central shaft, portion or section 66, a handle member 68 at one end, and a hook member 70 distally opposite handle member 78. Hook member 70 is angularly disposed relative to central portion 66 to extend away from handle member 68 such that hook member 70 may be directed inwardly toward products 22 contained within pan member 26 when retention member 28 is held by a user and positioned as shown in FIG. 1. Retention arm member 28 is shown as being slightly longer than pan member 26.

In operation, pan member 28 may be used for removing and/or placing products 22 on shelf 24, where shelf 24 comprises an elongate shelf such as is employed in retail environments and has a width 72. It should be appreciated that the length of shelf 24 would extend along an aisle traversed by customers, and that additional shelves may be positioned above or below shelf 24.

To remove products 22 from shelf 24, pan member 26 is initially placed adjacent products 22 located on shelf 24, with front edge 38 being oriented generally perpendicular to the length of shelf 24 and in contact with shelf 24. In the embodiment shown, base portion 30 has a length that is approximately equal to the width 72 of shelf 24. Pan member 26 may then be slid relative to products 22 to scoop products 22 into pan member 26 whereby the products 22 are contained within pan member 26 as shown in FIG. 1. As is conventional, products 22 are arranged for displaying on shelf 24 in orderly rows in an upright manner for viewing by consumers. Use of pan member 26 to remove products 22 from shelf 24 in the manner described enables the products 22 to retain this orientation within pan member 26 as understood from FIG. 1.

Additionally or alternatively, retention arm member 28 may be placed opposite products 22 relative to pan member 26 prior to moving pan member 26 such that products 22 are positioned between retention arm member 28 and pan member 26. Retention arm member 28 may then be used to provide a biasing force to prevent products 22 from sliding along shelf 24 and/or tipping over from an upright position. It should be appreciated that as an alternative to retention arm member 28, that an individual may provide a biasing force with their hand and/or their arm. Still further, rather than move pan member 26 while products 22 remain stationary, retention arm member 28 may be used to slide products 22 into pan member 26, and/or products 22 and pan member 26 may be moved simultaneously.

As understood from FIG. 1, products 22 are contained within pan member 26 in upright rows such that they may be re-positioned, such as to other shelves, or into boxes, or otherwise stored. The shelving unit of which shelf 24 is connected may then be re-positioned or shelf 24 may be restocked with other products.

Correspondingly, to place products 22 onto an initially empty location of shelf 24, products may first be arranged in an upright manner within pan member 26, such as in rows as shown in FIG. 1. For example, products 22 may be removed from shipping boxes in which they are received and initially placed in pan member 26, or products 22 that were previously removed or located on a shelf may be picked up with pan member 26 as described above. Pan member 26 is then positioned adjacent shelf 24, such as with front edge 38 being arranged generally perpendicularly relative to the elongate length of shelf 24 and in contact with shelf 24 as also shown in FIG. 1. Products 22 are then slid out of pan member 26 such that they are placed onto shelf 24 in orderly rows and in an upright manner. A biasing force may also be applied to products 22 as they are slid from pan member 26 to aid in maintaining products 22 in the upright and orderly arranged orientation shown in FIG. 1. Such a biasing force may be applied by the opposite hand and/or arm of a user relative to the hand being used to hold pan member 26. Alternatively, retention arm member 28 may be used to apply such a biasing force.

The apparatus and method for removing and restocking shelves of the present invention enables items, such as retail goods or other such products, to be quickly and efficiently moved while maintaining their orientation, including moving multiple of such items simultaneously. The apparatus and method, therefore, provide significant time and cost savings to conventional practices such as individually moving products by hand.

Changes and modifications in the specifically described embodiments can be carried out without departing from the principles of the present invention which is intended to be limited only by the scope of the appended claims, as interpreted according to the principles of patent law including the doctrine of equivalents. For example, it should be appreciated that alternatively sized and shaped pan members and/or retention arm members may be employed within the scope of the present invention. Still further, the apparatus and method described herein may be practiced in environments other than retail store facilities, such as in warehouses or factories in which parts are stored or used.

The embodiments of the invention in which an exclusive property or privilege is claimed are defined as follows:

1. A method of handling products on shelves, said method comprising: providing a pan member, said pan member including a base portion connected to a back portion with said back portion including a handle member and being angularly oriented relative to said base portion, said base portion including a front edge with said back portion being connected to said base portion opposite said front edge;

placing said front edge of said pan member adjacent a plurality of products stored on a shelf;

sliding said pan member and at least a portion of the products relative to each other such that at least a portion of the products are contained in said pan member whereby the contained products may be moved from the shelf;

wherein said pan member has first and second distal ends, and wherein said pan member includes pan end portion at said first end with said end portion being connected to said base portion and said back portion, and wherein said second end comprises pan open end, and wherein the length of said base portion is approximately equal to the width of the shelf upon which the products are stored, and wherein said placing said front edge of said pan member adjacent a plurality of products stored on a shelf comprises placing said front edge of said pan member in a perpendicular orientation relative to the elongate length of the shelf, and wherein said sliding said pan member and at least a portion of the products relative to each other comprises sliding said pan member and at least a portion of the products relative to each other in a direction parallel to the elongate length of the shelf, with said method further comprising:

providing a retention arm member, said retention arm member including a distally located handle member and pan elongate shaft extending from said handle member, and providing a biasing force to the at least a portion of the products opposite said pan member with said retention arm member such that the at least a portion of the products are positioned between said retention arm member and said pan member with said shaft being held generally parallel relative to said front edge of said pan member.

2. The method of claim 1, further including providing said biasing force to the at least a portion of the products opposite said pan member such that the at least a portion of the products are positioned between said biasing force and said pan member.

3. The method of claim 1, wherein said retention arm member includes a hook member, said hook member being angled relative to said shaft and being distally located from said handle member.

4. The method of claim 1, wherein after said sliding said pan member and at least a portion of the products relative to each other such that at least a portion of the products are contained in said pan member, said method further comprises:

positioning said pan member adjacent a shelf when said pan member contains a plurality of products for storage on the shelf with said front edge of said pan member in contact with the shelf; and sliding the products contained in said pan member out of said pan member such that the products are positioned on the shelf.

5. A method of handling products on shelves, said method comprising: providing a pan member, said pan member including a base portion connected to a back portion with said back portion including a handle member and being angularly oriented relative to said base portion, said base portion including a front edge with said back portion being connected to said base portion opposite said front edge;

placing a plurality of products in an upright orientation into said pan member; positioning said pan member adjacent a shelf with said front edge of said pan member in contact with the shelf;

sliding the products contained in said pan member out of said pan member such that the products are positioned on the shelf in an upright orientation;

said positioning said an member adjacent a shelf with said front edge of said pan member in contact with the shelf comprises placing said front edge of said pan member in a perpendicular orientation relative to the elongate length of the shelf, and wherein said sliding the products contained in said an member out of said an member comprises sliding the products in a direction parallel to the elongate length of the shelf;

providing a retention arm member, and wherein said retention arm member is used in the step of providing a biasing force;

wherein after said sliding the products contained in said an member out of said pan member, said method further comprises:

placing said front edge of said an member adjacent a plurality of the products stored on the shelf; and sliding said an member and at least a portion of the products relative to each other such that at least a portion of the products are contained in said an member whereby the contained products may be moved from the shelf.

6. The method of claim 5 further including providing said biasing force to the products during said sliding the products contained in said pan member out of said pan member.

7. The method of claim 5, wherein said retention arm member includes a distally located handle member and an elongate shaft extending from said handle member, and wherein said shaft is held generally parallel relative to said front edge during said providing a biasing force.

8. The method of claim 5, wherein said pan member has first and second distal ends, and wherein said pan member includes an end portion at said first end with said end portion being connected to said base portion and said back portion, and wherein said second end comprises an open end.

9. The method of claim 5, wherein the length of said base portion is approximately equal to the width of the shelf upon which the products are positioned.

* * * * *